US009869263B2

(12) United States Patent
Parisi et al.

(10) Patent No.: US 9,869,263 B2
(45) Date of Patent: Jan. 16, 2018

(54) METHOD OF CONTROLLING A SOLENOID VALVE

(71) Applicant: GM GLOBAL TECHNOLOGY OPERATIONS LLC, Detroit, MI (US)

(72) Inventors: Filippo Parisi, Turin (IT); Paolo Casasso, Cuneo (IT)

(73) Assignee: GM Global Technology Operations LLC, Detroit, MI (US)

( * ) Notice: Subject to any disclaimer, the term of this patent is extended or adjusted under 35 U.S.C. 154(b) by 560 days.

(21) Appl. No.: 14/538,105

(22) Filed: Nov. 11, 2014

(65) Prior Publication Data

US 2015/0128913 A1 May 14, 2015

(30) Foreign Application Priority Data

Nov. 11, 2013 (GB) ..... 1319873.4

(51) Int. Cl.
*F02M 63/00* (2006.01)
*F02D 41/20* (2006.01)
*F02D 41/24* (2006.01)

(52) U.S. Cl.
CPC ..... *F02D 41/20* (2013.01); *F02D 41/2467* (2013.01); *F02D 2041/2027* (2013.01); *F02D 2041/2058* (2013.01)

(58) Field of Classification Search
CPC .. F02D 41/20; F02D 41/2027; F02D 41/2058; F02D 41/2467
USPC ..... 361/139, 144, 145
See application file for complete search history.

(56) References Cited

U.S. PATENT DOCUMENTS

2005/0111160 A1* 5/2005 Faggioli ..... F02D 41/20 361/154
2011/0251777 A1* 10/2011 Farah ..... F02D 41/30 701/103

FOREIGN PATENT DOCUMENTS

EP 1521284 A2 4/2005

OTHER PUBLICATIONS

Intellectual Property Office of the United Kingdom, Search Report dated May 20, 2014 for GB 1319873.4.

* cited by examiner

*Primary Examiner* — Hieu T Vo
*Assistant Examiner* — Arnold Castro
(74) *Attorney, Agent, or Firm* — Lorenz & Kopf, LLP

(57) ABSTRACT

A method of controlling a solenoid valve of an automotive system, the valve being charged by a pulse width modulated signal (PWM) and determining an actuation of an automotive system component is provided. The method comprises the following: determining a target end of command of the valve as a function of a PWM state and a time interval from a last change of PWM state; monitoring a current value, a PWM phase period and the PWM state of a last pulse width modulated signal; and correcting in the next pulse width modulated signal at least one of said current value and PWM phase period, so that a next end of command of the valve will occur at the target end of command.

12 Claims, 5 Drawing Sheets

METHOD OF CONTROLLING A SOLENOID VALVE

CROSS REFERENCE TO RELATED APPLICATION

This application claims priority to British Patent Application No. 1319873.4 filed Nov. 11, 2013, which is incorporated herein by reference in its entirety.

TECHNICAL FIELD

The technical field relates to a method of controlling a solenoid valve, in particular the method is suitable for solenoid valves controlled via a pulse width modulated signal. A typical application of the present method is on the solenoid valve of a fuel injector of internal combustion engines.

BACKGROUND

Internal combustion engines are using several current controlled solenoid valves. Normally, a solenoid valve is electrically actuated by the ECU via a pulse width modulated signal (PWM), expressed as a duty cycle (DC) in percentage. As known, pulse width modulated (PWM) is a modulated technique that conforms the width of the pulse, formally the pulse duration, based on a modulator signal information. The average value of voltage (and current) fed to the load is controlled by turning the switch between supply and load on and off at a fast pace. The longer the switch is on compared to the off periods, the higher the power supplied to the load is. The term duty cycle describes the proportion of 'on' time to the regular interval or 'period' of time; a low duty cycle corresponds to low power, because the power is off for most of the time. As mentioned, duty cycle is normally expressed in percent, 100% being fully on.

Many modern engines are provided with a fuel injection system for directly injecting the fuel into the cylinders of the engine. The fuel injection system generally comprises a fuel common rail and a plurality of electrically controlled fuel injectors, which are individually located in a respective cylinder of the engine and which are fluidly connected to the fuel rail through dedicated injection lines. Each fuel injector generally comprises a nozzle and a movable needle which repeatedly opens and closes this nozzle, and fuel can thus be injected into the cylinder giving rise to single or multi-injection patterns at each engine cycle.

The needle is moved with the aid of a dedicated actuator, typically a solenoid valve, which is controlled by the ECU. The ECU operates each fuel injection by generating an electric command, via a pulse width modulated signal (PWM), causing the actuator to open the fuel injector nozzle for a predetermined amount of time, and a subsequent end of command (EOC), causing the actuator to close the fuel injector nozzle. The time between the electric opening command and the EOC is generally referred as energizing time (ET) of the fuel injector, and it is determined by the ECU as a function of a desired quantity of fuel to be injected.

For a solenoid valve, which is driven via a PWM signal, the electrical control of the current shape is affected by errors. In particular, the error introduced by the uncontrolled starting point of the final current switch-off before the final EOC current switch-off. This error can be considered mainly a slowly variable delay that influences the accuracy of the solenoid valve control. The error is also present in commands with the same energizing time.

FIG. 3 shows an example of the mentioned error affecting an injector current control of two pulses with the same energizing time. The graph is a plot of the solenoid valve current versus time. As can be seen from the figure, the two current pulses 500, 510 having the same energizing time, have the end of command EOC exactly at the same time. Notwithstanding this, the current shape of the pulses differently behaves and at a given current value (for example a current value of 1.4 A, which is still able to maintain the injector needle open, i.e. to let the fuel injection continue) current pulse 510 has a time delay $\Delta t_i$ of about 2 μs. This uncontrolled error causes a remarkable variation in the fuel injection quantity (above all, in case of small injection quantities), since a common rail injector has a typical fuel quantity vs. command time sensitivity of about 0.15-0.3 $mm^3/\mu s$ at 200 MPa. This error is due to the operating conditions: for example, environment temperature and/or system voltage, influence the PWM signal and consequently the end of the injection.

Therefore a need exists for a method of controlling a solenoid valve, which does not suffer of the above inconvenience.

In addition, other objects, desirable features and characteristics will become apparent from the subsequent summary and detailed description, and the appended claims, taken in conjunction with the accompanying drawings and this background.

SUMMARY

The various teachings of the present disclosure provide a method of controlling solenoid valves, which minimizes the error at the end of command, due to variation of system parameters, shot to shot. An embodiment of the disclosure provides a method of controlling a solenoid valve of an automotive system, the valve being charged by a pulse width modulated signal and determining an actuation of an automotive system component, wherein the method comprises: determining a target end of command of the valve as a function of a PWM state and a time interval from a last change of PWM state, monitoring a current value, a PWM phase period and the PWM state of a last pulse width modulated signal, and correcting in the next pulse width modulated signal at least one of said current value and PWM phase period, so that a next end of command of the valve will occur at the target end of command.

Consequently, an apparatus is disclosed for performing the method of controlling a solenoid valve of an automotive system, the apparatus comprising: means for determining a target end of command of the valve as a function of a PWM state and a time interval from a last change of PWM state, means for monitoring a current value, a PWM phase period and the PWM state of a last pulse width modulated signal, and means for correcting in the next pulse width modulated signal at least one of said current value and PWM phase period, so that a next end of command of the valve will occur at the target end of command.

An advantage of this embodiment is that this method definitively improves the control of a solenoid valve actuator, by compensating the error at the end of command. It reduces the end of command variation, which affects the physical quantity the device is controlling and delivering; furthermore it reduces electromagnetic compatibility (EMC) emission, by controlling the start of EOC event at the end of a current recirculation phase (Off phase).

According to one embodiment, said corrected current value is a maximum hold current value.

Consequently, said means for correcting in the next pulse width modulated signal at least one of said current value and PWM phase period are configured to operate if said corrected current value is a maximum hold current value.

An advantage of this embodiment is that the maximum hold current value is a characteristic parameter of the PWM signal and can be corrected without any effort.

According to one embodiment, said corrected PWM phase period is a phase period before the PWM holding phase.

Consequently, said means for correcting in the next pulse width modulated signal at least one of said current value and PWM phase period are configured to operate if said corrected PWM phase period is a phase period before the PWM holding phase.

An advantage of this embodiment is that also the phase period of the PWM holding phase is a characteristic parameter of the PWM signal and can be corrected without any effort.

According to one embodiment, both the maximum hold current value and the pulse width modulated phase period are corrected.

Consequently, said means for correcting in the next pulse width modulated signal at least one of said current value and PWM phase period are configured to operate if both the maximum hold current value and the pulse width modulated phase period are corrected.

An advantage of this embodiment is that the correction can be more easily balanced between the two parameters defining the current shape, and can converge in a faster way.

According to an embodiment, the correction of both the maximum hold current value and the pulse width modulated phase period is done using a weight, which is respectively (1−k) and k, wherein k is a factor larger than 0 and smaller than 1.

Consequently, said means for correcting in the next pulse width modulated signal at least one of said current value and PWM phase period are configured to operate if the correction of both the maximum hold current value and the pulse width modulated phase period is done using a weight, which is respectively (1−k) and k, wherein k is a factor larger than 0 and smaller than 1.

An advantage of this embodiment is that the balance between the correction by means of the maximum hold current value and the pulse width modulated phase period is performed by a simple linear interpolation.

An embodiment of the disclosure provides an internal combustion engine comprising at least and a solenoid valve, wherein the solenoid valve is controlled by a method according to any of the previous embodiments.

According to an embodiment, the internal combustion engine comprises a fuel injection system and the solenoid valve acts as an actuator of a fuel injector.

The method can be carried out with the help of a computer program comprising a program-code for carrying out all the steps of the method described above, and in the form of computer program product comprising the computer program.

The computer program product can be embedded in a control apparatus for an internal combustion engine, comprising an Electronic Control Unit (ECU), a data carrier associated to the ECU, and the computer program stored in a data carrier, so that the control apparatus defines the embodiments described in the same way as the method. In this case, when the control apparatus executes the computer program all the steps of the method described above are carried out.

A person skilled in the art can gather other characteristics and advantages of the disclosure from the following description of exemplary embodiments that refers to the attached drawings, wherein the described exemplary embodiments should not be interpreted in a restrictive sense.

BRIEF DESCRIPTION OF THE DRAWINGS

The present disclosure will hereinafter be described in conjunction with the following drawing figures, wherein like numerals denote like elements, and.

DETAILED DESCRIPTION

The following detailed description is merely exemplary in nature and is not intended to limit the present disclosure or the application and uses of the present disclosure. Furthermore, there is no intention to be bound by any theory presented in the preceding background or the following detailed description.

Figure 1:
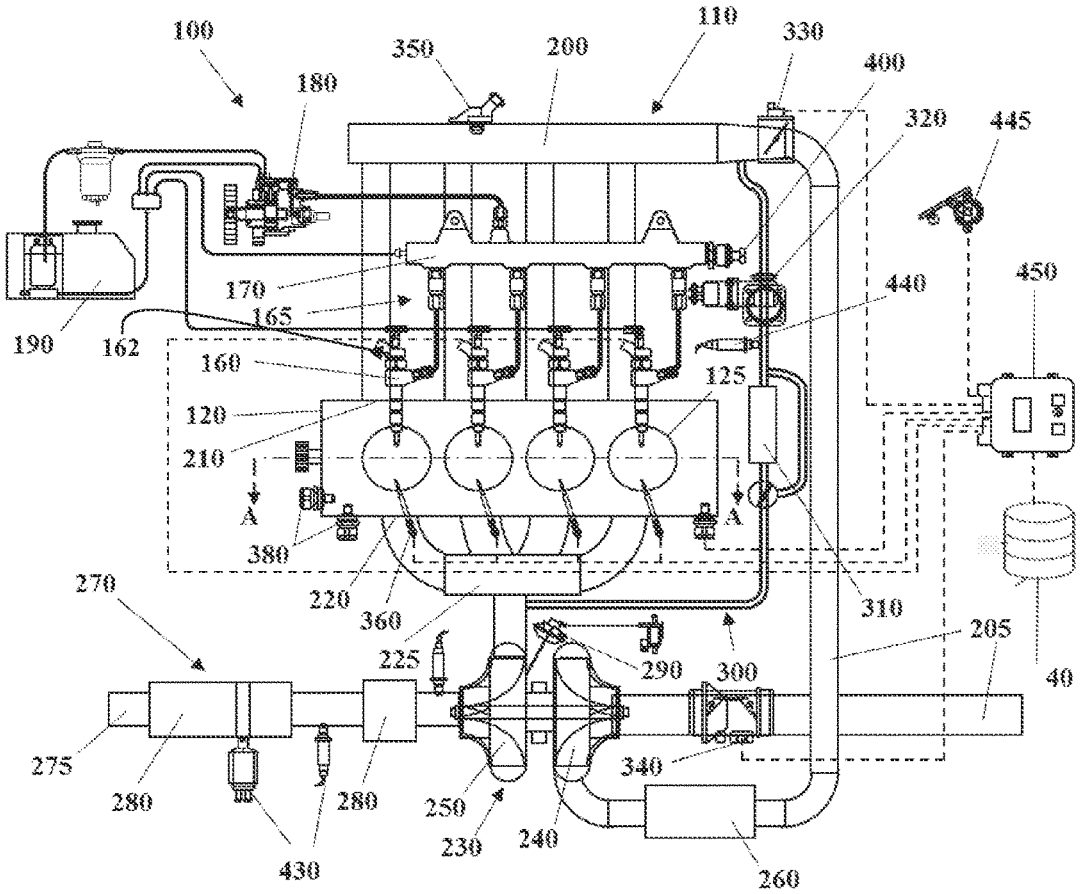
FIG. 1 shows an automotive system.
Figure 2:
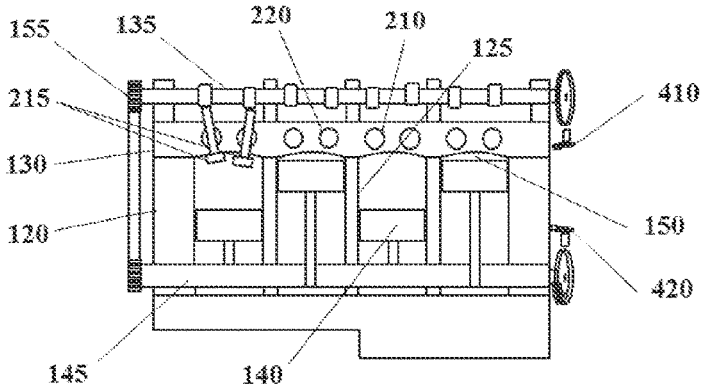
FIG. 2 is a section of an internal combustion engine belonging to the automotive system of FIG. 1.
Figure 3:
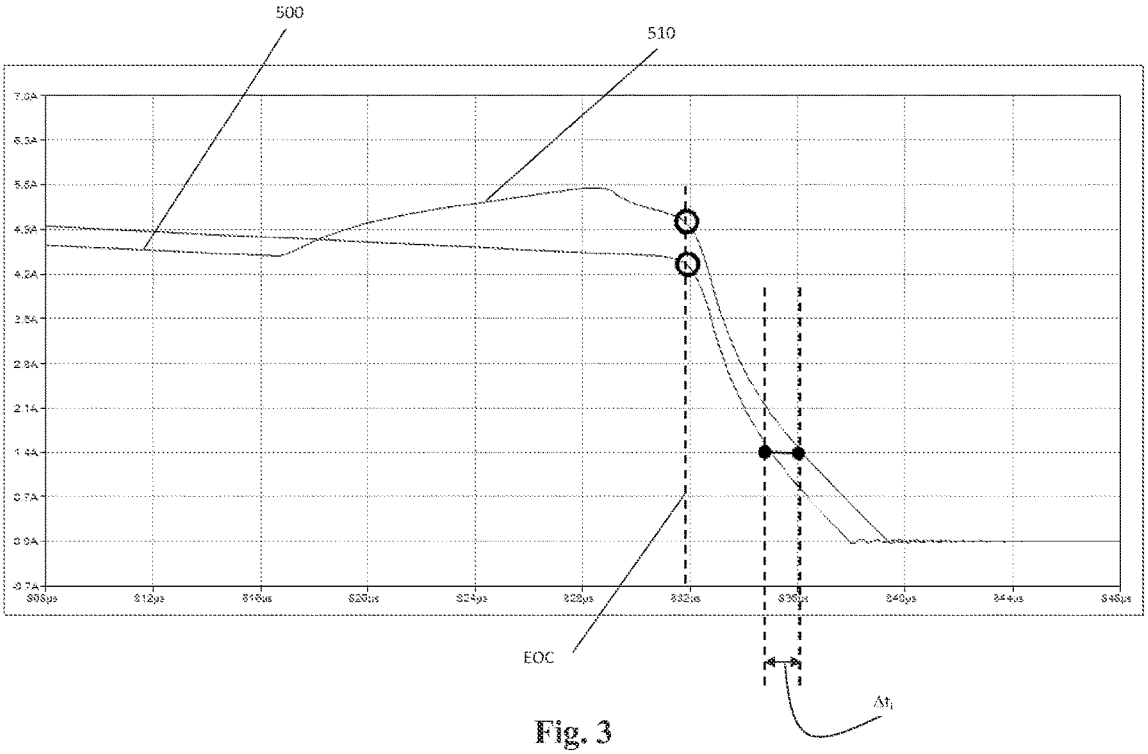
FIG. 3 is a graph showing the current shape error due to the known solenoid valve controls.

Some embodiments may include an automotive system 100, as shown in FIGS. 1 and 2, that includes an internal combustion engine (ICE) 110 having an engine block 120 defining at least one cylinder 125 having a piston 140 coupled to rotate a crankshaft 145. A cylinder head 130 cooperates with the piston 140 to define a combustion chamber 150.

A fuel and air mixture (not shown) is disposed in the combustion chamber 150 and ignited, resulting in hot expanding exhaust gasses causing reciprocal movement of the piston 140. The fuel is provided by at least one fuel injector 160 and the air through at least one intake port 210. The fuel is provided at high pressure to the fuel injector 160 from a fuel rail 170 in fluid communication with a high pressure fuel pump 180 that increase the pressure of the fuel received from a fuel source 190.

Each of the cylinders 125 has at least two valves 215, actuated by a camshaft 135 rotating in time with the crankshaft 145. The valves 215 selectively allow air into the combustion chamber 150 from the port 210 and alternately allow exhaust gases to exit through a port 220. In some examples, a cam phaser 155 may selectively vary the timing between the camshaft 135 and the crankshaft 145.

The air may be distributed to the air intake port(s) 210 through an intake manifold 200. An air intake duct 205 may provide air from the ambient environment to the intake manifold 200. In other embodiments, a throttle body 330 may be provided to regulate the flow of air into the manifold 200. In still other embodiments, a forced air system such as a turbocharger 230, having a compressor 240 rotationally coupled to a turbine 250, may be provided. Rotation of the compressor 240 increases the pressure and temperature of the air in the duct 205 and manifold 200. An intercooler 260 disposed in the duct 205 may reduce the temperature of the air. The turbine 250 rotates by receiving exhaust gases from an exhaust manifold 225 that directs exhaust gases from the exhaust ports 220 and through a series of vanes prior to expansion through the turbine 250. The exhaust gases exit the turbine 250 and are directed into an exhaust system 270. This example shows a fixed geometry turbine 250 including a waste gate 290. In other embodiments, the turbocharger 230 may be a variable geometry turbine (VGT) with a VGT actuator arranged to move the vanes to alter the flow of the exhaust gases through the turbine.

The exhaust system 270 may include an exhaust pipe 275 having one or more exhaust aftertreatment devices 280. The aftertreatment devices may be any device configured to change the composition of the exhaust gases. Some examples of aftertreatment devices 280 include, but are not limited to, catalytic converters (two and three way), oxidation catalysts, lean NOx traps, hydrocarbon adsorbers, selective catalytic reduction (SCR) systems. Other embodiments may include an exhaust gas recirculation (EGR) system 300 coupled between the exhaust manifold 225 and the intake manifold 200. The EGR system 300 may include an EGR cooler 310 to reduce the temperature of the exhaust gases in the EGR system 300. An EGR valve 320 regulates a flow of exhaust gases in the EGR system 300.

The automotive system 100 may further include an electronic control unit (ECU) 450 in communication with one or more sensors and/or devices associated with the ICE 110 and equipped with a data carrier 40. The ECU 450 may receive input signals from various sensors configured to generate the signals in proportion to various physical parameters associated with the ICE 110. The sensors include, but are not limited to, a mass airflow, pressure, temperature sensor 340, a manifold pressure and temperature sensor 350, a combustion pressure sensor 360, coolant and oil temperature and level sensors 380, a fuel rail pressure sensor 400, a cam position sensor 410, a crank position sensor 420, exhaust pressure and temperature sensors 430, an EGR temperature sensor 440, and an accelerator pedal position sensor 445. Furthermore, the ECU 450 may generate output signals to various control devices that are arranged to control the operation of the ICE 110, including, but not limited to, the fuel injectors 160, the throttle body 330, the EGR Valve 320, the waste gate actuator 290, and the cam phaser 155. Note, dashed lines are used to indicate communication between the ECU 450 and the various sensors and devices, but some are omitted for clarity.

Turning now to the ECU 450, this apparatus may include a digital central processing unit (CPU) in communication with a memory system and an interface bus. The CPU is configured to execute instructions stored as a program in the memory system, and send and receive signals to/from the interface bus. The memory system may include various storage types including optical storage, magnetic storage, solid state storage, and other non-volatile memory. The interface bus may be configured to send, receive, and modulate analog and/or digital signals to/from the various sensors and control devices. The program may embody the methods disclosed herein, allowing the CPU to carryout out the steps of such methods and control the ICE 110.

The program stored in the memory system is transmitted from outside via a cable or in a wireless fashion. Outside the automotive system 100 it is normally visible as a computer program product, which is also called computer readable medium or machine readable medium in the art, and which should be understood to be a computer program code residing on a carrier, said carrier being transitory or non-transitory in nature with the consequence that the computer program product can be regarded to be transitory or non-transitory in nature.

An example of a transitory computer program product is a signal, e.g. an electromagnetic signal such as an optical signal, which is a transitory carrier for the computer program code. Carrying such computer program code can be achieved by modulating the signal by a conventional modulated technique such as QPSK for digital data, such that binary data representing said computer program code is impressed on the transitory electromagnetic signal. Such signals are e.g. made use of when transmitting computer program code in a wireless fashion via a WiFi connection to a laptop.

In case of a non-transitory computer program product the computer program code is embodied in a tangible storage medium. The storage medium is then the non-transitory carrier mentioned above, such that the computer program code is permanently or non-permanently stored in a retrievable way in or on this storage medium. The storage medium can be of conventional type known in computer technology such as a flash memory, an Asic, a CD or the like.

Instead of an ECU 450, the automotive system 100 may have a different type of processor to provide the electronic logic, e.g. an embedded controller, an onboard computer, or any processing module that might be deployed in the vehicle.

According to an embodiment of the present disclosure, the method can be applied to a solenoid valve 162 acting as an actuator of a fuel injector 160, belonging to an internal combustion engine 110 comprising a fuel injection system 165. From now on, the description will be referred to such injector actuator but it is to be intended that the method, according to various embodiments, can be applied to whatever solenoid valve of an internal combustion engine and/or an automotive system.

Figure 4:
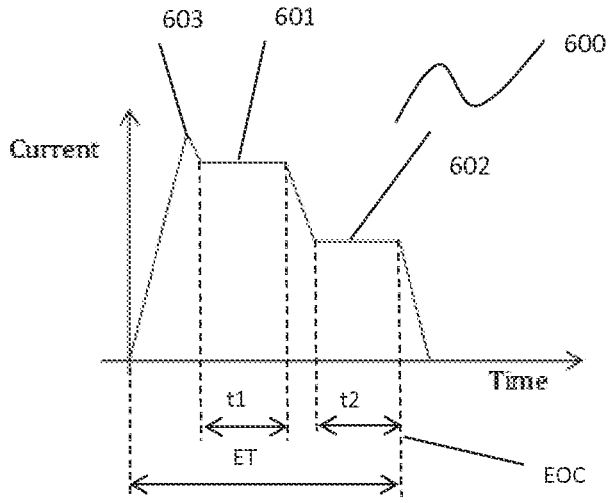
FIG. 4 schematizes a standard energizing electrical current profile.

FIG. 4 schematizes a standard energizing electrical current profile 600, which comprises, after a quick current ramp up (called pull-in current until the max. value 603 is reached), a first time interval t1 during which the current assumes a remarkably high value, in the order of 10-20 A, the so called "peak" current 601. Reason for this high current value is to accelerate as much as possible the injector opening. As soon as such conditions are satisfied, the current value to guarantee the injector needle remains lifted is lower, in the order of less than 10 A. Therefore, the second time interval t2 of the standard energizing electrical current profile is characterized by a current hold value 602, smaller than the peak current 601. The graph is really schematic: in reality during the first and the second time interval, t1, t2, the current values are not constant but, due to the PWM command, they will be increased and decreased cyclically. As known, the time between the electric opening command and the EOC is generally referred as energizing time ET of the fuel injector.

According to an embodiment of the present disclosure, the method aims to control solenoid valve in order not to have, for a given energizing time ET, a different end of the injection from one electric pulse to the subsequent one. In other words, the methods wants to avoid that the electrical pulses, having the same energizing timer, differently behave after the end of command (EOC) and this can be done adjusting the current parameters of the PWM signal in a way that the EOC always occurs at the same time.

Figure 5:
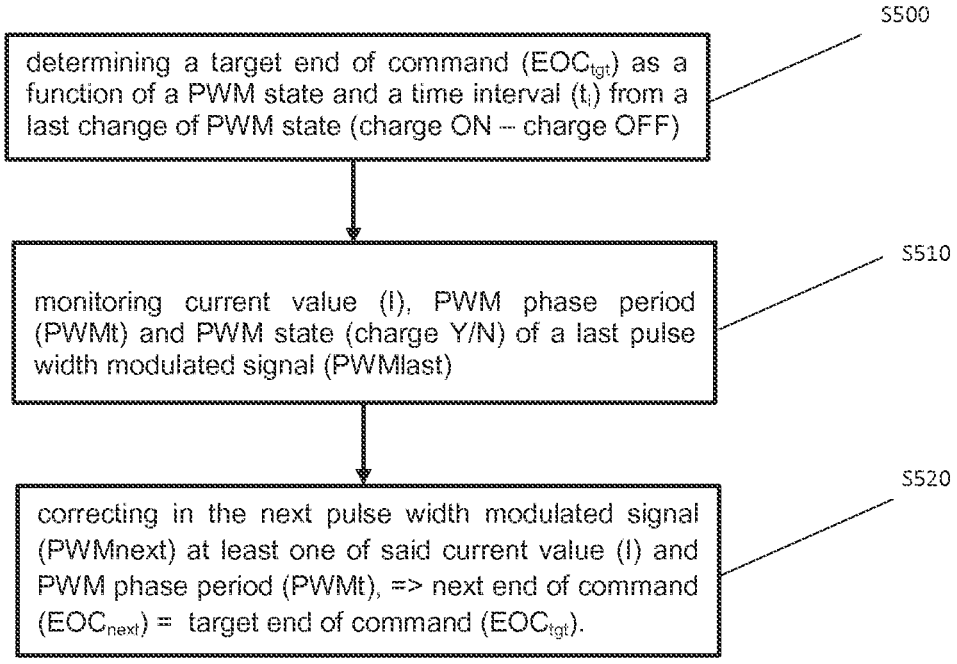
FIG. 5 is a flowchart of the method according to an exemplary embodiment of the present disclosure.

With reference to FIG. 5, which shows a high level flowchart, first of all the method determines S500 a target end of command $EOC_{tgt}$ of the valve as a function of a PWM state (valve charge or discharge) and a time interval $t_i$ from a last change of PWM state This target end of command can be, for example, a change of state of the PWM signal from a discharge to a charge. Then, the method monitors S510 the last pulse width modulated signal PWMlast, in terms of a current value I, a PWM phase period PWMt and a PWM state. The current value I and the PWM phase period PWMt are characteristic parameters of the monitored PWM signal. The PWM phase period PWMt can be monitored by using timer counts, which is representative of the last PWM phase period before the EOC event. The PWM state simply means if the current inside the solenoid valve is increasing (charge phase) or decreasing (discharge phase) and can be monitored by using a "flag", which is representative of the status of the PWM (On/off) and relative to the above timer counts.

Also a pulse index pi and a cylinder index ci can be monitored. The pulse index and the cylinder index are parameters connected to the function of the solenoid valve. In the case the valve is operating as injector actuator, the pulse index identifies the specific injection (pilot injection, main injection, post injection, and so on) while the cylinder index identifies the current cylinder in which the injection takes place.

Finally, the method corrects S520 in the next pulse width modulated signal PWMnext at least one of said current value I and PWM phase period PWMt, so that the next end of command $EOC_{next}$ of the valve will occur at the target end of command $EOC_{tgt}$, approximately, after some iterations. In fact, monitoring the last PWM period and the related status before the end of command (EOC), it is possible to correct one or more current shape parameters (timing or current value) keeping the current switch off starting point controlled as expected. The corrections shall be applied to the next commands.

Figure 6:
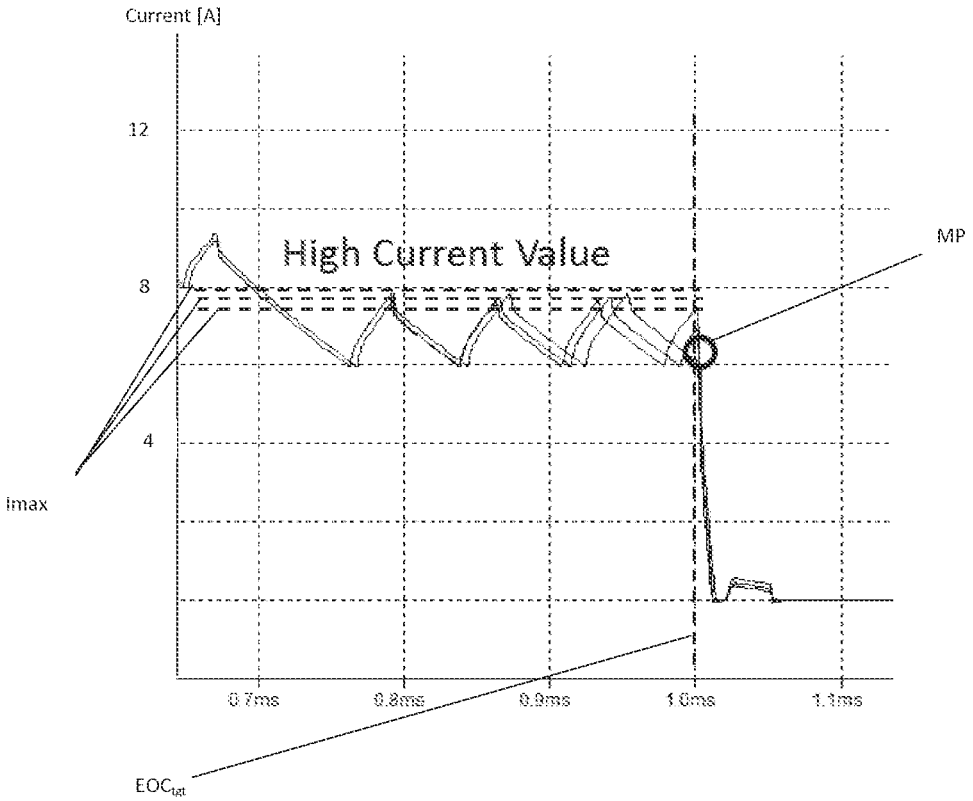
FIG. 6 is a graph showing an exemplary embodiment of the present disclosure, according to the maximum hold current control.

According to an embodiment, the corrected current value I is a maximum hold current value Imax. The algorithm shall use the above data increasing in steps the high-current value of the related holding phase until the end of injection event happens in the expected position. Of course, also different characteristic current values can be chosen. FIG. 6 shows a graph with a simulation of what can happen by controlling the maximum hold current value Imax. In the graph three behaviors of the hold current vs. time are shown. Each curve is obtained by varying the maximum hold current value Imax (7.4, 7.6 and 7.8 A, in the example). As can be seen, such controlling variable can be adjusted in order to exactly match the monitoring point MP in terms of time. Such monitoring point corresponds to the end of command $EOC_{tgt}$ (1 ms in the example). If the solenoid discharge starts at the same current value, also the end of the event (in our case, the end of the injection) will occur at the same time.

Figure 7:
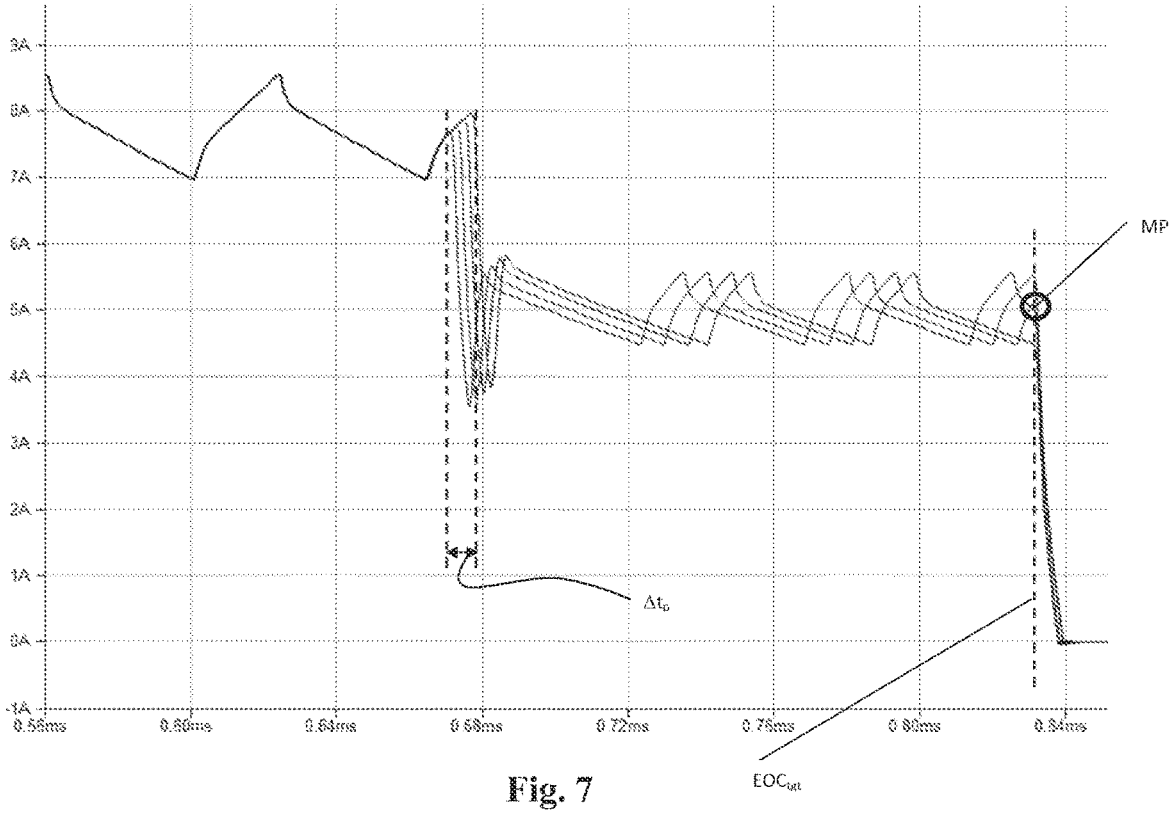
FIG. 7 is a graph showing an exemplary embodiment of the present disclosure, according to the PWM phase period control.

According to an embodiment, the corrected PWM phase period PWMt, is a phase period before the PWM holding phase. The algorithm shall use the above data increasing in steps the previous time period of the current shape until the end of injection event happen in the expected position. FIG. 7 shows a graph with a simulation of what can happen by controlling the phase period of the PWM holding phase. In the graph four behaviors of the PWM holding phase vs. time are shown. Each curve is obtained by varying the phase period of a quantity $\Delta t_p$ (respectively, 0, 2, 4 and 6 μs, in the example).

As can be seen, also in this case such controlling variable can be adjusted in order to exactly match the monitoring point MP in terms of time, better target end of command $EOC_{tgt}$.

According to an embodiment, the parameters the algorithm can correct are both the maximum hold current value Imax and the pulse width modulated phase period PWMt. The correction can be more easily balanced between the two parameters defining the current shape and can converge in a faster way. In this case, a weighing factor can be introduced. For example, the maximum hold current value Imax can be multiplied by (1−k) and the pulse width modulated phase period PWMt can be multiplied by k, wherein k is a factor larger than 0 and smaller than 1. Therefore, the balance between the correction by means of the maximum hold current value and the pulse width modulated phase period is performed by a simple linear interpolation.

Summarizing, by the present method is possible to minimize the uncompensated error of the valve actuated quantity (e.g. for a fuel injection, the error at 200 MPa is in the range 0.2-0.3 $mm^3/\mu s$). This method definitively improves the control of a solenoid valve actuator compensating the error at EOC. Hereafter the main direct advantages: reducing the present end of command variation, which affects the physical quantity the device is controlling and delivering; reducing EMC emission, by controlling the start of EOC event at the end of a current recirculation phase (i.e. "off" phase); no needs of extra components.

While at least one exemplary embodiment has been presented in the foregoing summary and detailed description, it should be appreciated that a vast number of variations exist. It should also be appreciated that the exemplary embodiment or exemplary embodiments are only examples, and are not intended to limit the scope, applicability, or configuration in any way. Rather, the foregoing summary and detailed description will provide those skilled in the art with a convenient road map for implementing at least one exemplary embodiment, it being understood that various changes may be made in the function and arrangement of elements described in an exemplary embodiment without departing from the scope as set forth in the appended claims and their legal equivalents.

The invention claimed is:

1. A method for controlling a solenoid valve of an automotive fuel injection system, the valve being charged by a pulse width modulated signal (PWM) and determining an actuation of an automotive system component, wherein the method comprises the steps of:

determining a target end of command of the solenoid valve as a function of a PWM state and a time interval from a last change of PWM state;

monitoring a current value, a PWM phase period and the PWM state of a last pulse width modulated signal; and correcting in the next pulse width modulated signal at least one of the current value and the PWM phase period, so that a next end of command of the solenoid valve will occur at the target end of command, wherein the corrected PWM phase period is a phase period before the PWM holding phase.

2. The method according to claim 1, wherein the corrected current value is a maximum hold current value.

3. The method according to claim 1, wherein the correcting comprises correcting both the maximum hold current value and the pulse width modulated phase period.

4. The method according to claim 3, wherein the correcting of both the maximum hold current value and the pulse width modulated phase period is done using a weight, which is respectively (1−k) and k, wherein k is a factor larger than 0 and smaller than 1.

5. An internal combustion engine, comprising:

at least a solenoid valve of a fuel injection system charged by a pulse width modulated signal (PWM), an electronic control unit for controlling the solenoid valve, the electronic control unit configured to:

determine a target end of command of the solenoid valve as a function of a PWM state and a time interval from a last change of PWM state;

monitor a current value, a PWM phase period and the PWM state of a last pulse width modulated signal; and correct in the next pulse width modulated signal at least one of the current value and the PWM phase period, so that a next end of command of the solenoid valve will occur at the target end of command, wherein the corrected PWM phase period is a phase period before the PWM holding phase.

6. The internal combustion engine according to claim 5, wherein the corrected current value is a maximum hold current value.

7. The internal combustion engine according to claim 5, wherein both the maximum hold current value and the pulse width modulated phase period are corrected.

8. The internal combustion engine according to claim 7, wherein the correction of both the maximum hold current value and the pulse width modulated phase period is done using a weight, which is respectively (1−k) and k, wherein k is a factor larger than 0 and smaller than 1.

9. The internal combustion engine according to claim 5, wherein the engine comprises a fuel injection system and the solenoid valve acts as an actuator of a fuel injector.

10. A computer program product, comprising:

a tangible storage medium readable by a processor and storing instructions for execution by the processor for performing a method comprising:

determining a target end of command of a solenoid valve of a fuel injection system as a function of a PWM state and a time interval from a last change of PWM state;

monitoring a current value, a PWM phase period and the PWM state of a last pulse width modulated signal; and correcting in the next pulse width modulated signal at least one of the current value and the PWM phase period, so that a next end of command of the solenoid valve will occur at the target end of command, wherein the corrected PWM phase period is a phase period before the PWM holding phase.

11. The computer program product according to claim 10, wherein the corrected current value is a maximum hold current value.

12. The computer program product according to claim 10, wherein the correcting comprises correcting both the maximum hold current value and the pulse width modulated phase period.

* * * * *